United States Patent [19]

Sherberne

[11] 4,147,469

[45] Apr. 3, 1979

[54] REPLACEABLE PADDLE BLADE

[76] Inventor: Charles W. Sherberne, 3409 S. Patton Ave., San Pedro, Calif. 90731

[21] Appl. No.: 841,695

[22] Filed: Oct. 13, 1977

[51] Int. Cl.[2] ..... B63H 16/04

[52] U.S. Cl. ..... 416/70 R; 416/74

[58] Field of Search ..... 416/70 R, 74

[56] References Cited

U.S. PATENT DOCUMENTS

| | | | |
|---|---|---|---|
| 358,034 | 2/1887 | Green | 416/237 X |
| 1,789,749 | 1/1931 | Herring | 416/70 |
| 2,711,547 | 6/1955 | Bliven | 416/74 |

FOREIGN PATENT DOCUMENTS

| | | | |
|---|---|---|---|
| 894659 | 10/1953 | Fed. Rep. of Germany | 416/74 |
| 1197174 | 11/1959 | France | 416/70 |
| 424147 | 8/1947 | Italy | 416/70 |

*Primary Examiner*—Everette A. Powell, Jr.
*Attorney, Agent, or Firm*—Fulwider, Patton, Rieber, Lee & Utecht

[57] ABSTRACT

A paddle blade adapted to be mounted to a tubular handle for use as a kayak or canoe paddle. The paddle blade is replaceable and includes a blade body with an elongated recess having a cylindrical end cavity adapted to receive the handle. A tubular element is located within the recess and the space between the element and the recess is filled with reinforcement material. The blade is curved and the tubular element is bent to fit within the longitudinally angulated portions of the recess in the blade body. The bend in the element is located against the inner wall of the recess and the adjacent end of the handle so that operating forces upon the paddle blade are transmitted directly to the handle in these areas.

5 Claims, 5 Drawing Figures

REPLACEABLE PADDLE BLADE

BACKGROUND OF THE INVENTION

1. Field of the Invention

The present invention relates to paddle blades for kayaks, canoes or the like.

2. Description of the Prior Art

Paddles for kayaks, canoes or the like are desirably strong and light in weight. It is also desirable for the paddle components to be separable for compact storage and shipment, and to be easily assemblable at the point of sale or use. Heretofore, paddle blades have usually been integrally attached to the handle, and the resulting assembly is long and relatively difficult to ship and stock.

Paddle blades are curved or configured to form a pocket for efficient negotiation of the water. The blade body frequently breaks or fails at the point where the blade body is curved away from the handle axis. In addition, the blade body is often insufficiently reinforced in other areas to bear the operating loads without failure.

SUMMARY OF THE INVENTION

According to the present invention, a paddle blade is provided which is adapted to be mounted to a tubular handle. The blade or blades can be stored and shipped separately of the handle and assembled at the point of use or sale. In addition, the blade can be substituted for an original blade which has become worn out or damaged.

The blade comprises a blade body including an elongated recess characterized by a cylindrical end cavity adapted to receive the tubular handle. Within the recess is located a tubular element, and the spaces between the tubular element and the walls of the recess are filled with reinforcement material which, in combination with the tubular element, resists lateral deflection of the blade body. The reinforcement material and the end cavity walls are uniformly spaced apart to define an annular socket for receiving the end of the tubular handle.

The blade body is preferably curved so that the recess end cavity is at an angle relative to the remainder of the recess. It is a feature of the present invention that the tubular element includes a bend enabling the element to fit within the angled portions of the recess, and that the bend fit against the adjacent inner wall of the recess without any significant amount of reinforcement material therebetween. With this arrangement operating loads in the critical bend area are not imposed upon the reinforcement material, which might eventually compress or crush under load, but are instead passed directly from the tubular element to the blade body and handle. In this regard, the bend area of the tubular element is also preferably located adjacent the inner end of the annular socket so that it can also pass operating loads directly to the handle.

The foregoing arrangement provides a light weight, high strength blade adapted for quick and easy assembly to the handle at the point of sale or use. Since the tubular element is located adjacent the blade body at critical load points, flexing and other operating loads borne by the blade body are efficiently transferred to the handle without unduly stressing or breaking the blade body where it is connected to the handle.

Other objects and features of the invention will become apparent from consideration of the following description taken in connection with the accompanying drawings.

DESCRIPTION OF THE PREFERRED EMBODIMENTS

Figures 1, 2, 3, 4, 5:
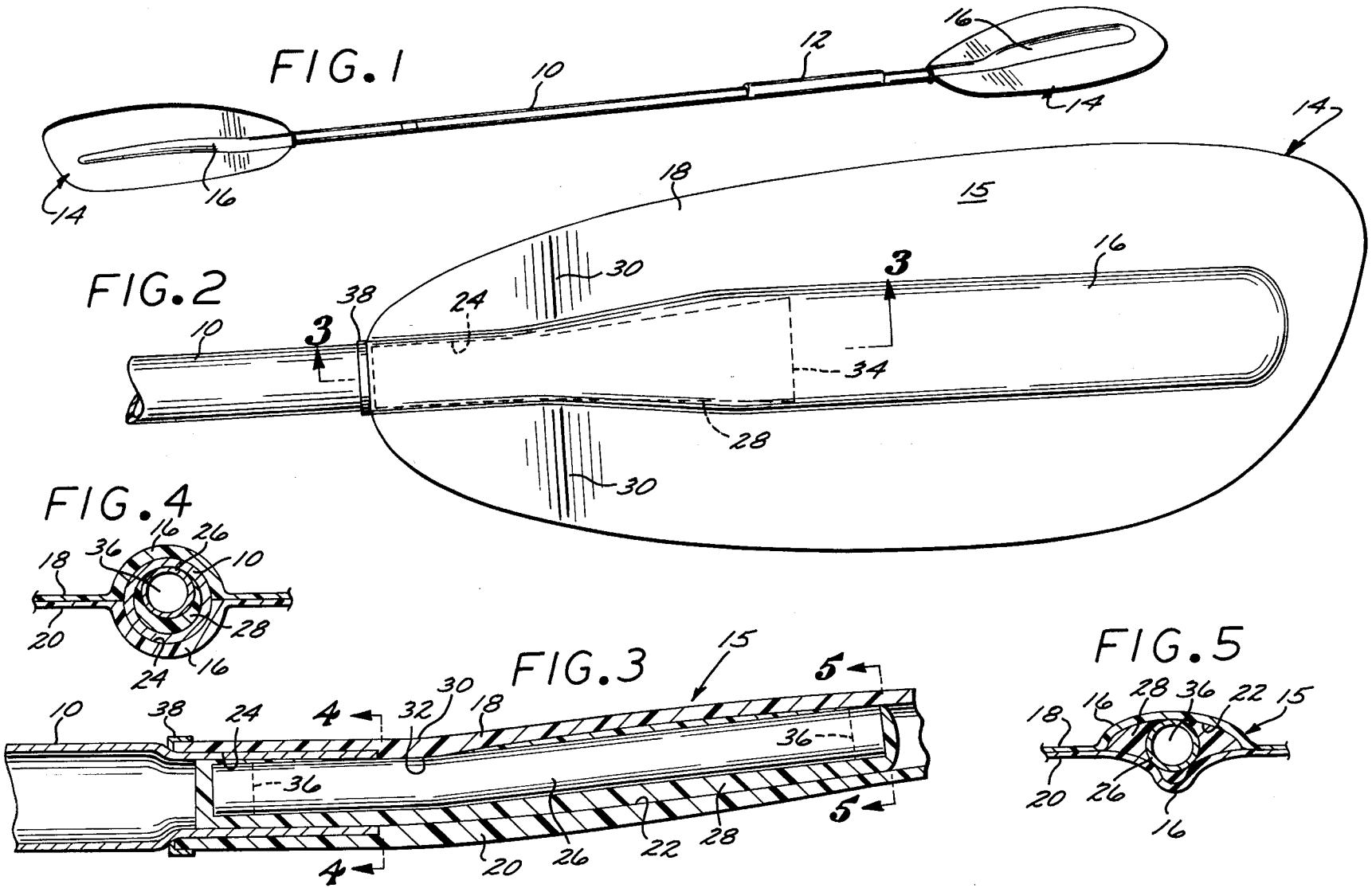
FIG. 1 is a perspective view of a paddle comprising a tubular handle attached to a pair of paddle blades according to the present invention.
FIG. 2 is an enlarged plan view of one of the blades of the paddle of FIG. 1.
FIG. 3 is an enlarged view taken along the line 3—3 of FIG. 2.
FIG. 4 is a view taken along the line 4—4 of FIG. 3.
FIG. 5 is a view taken along the line 5—5 of FIG. 3.

Referring now to the drawings, there is illustrated a paddle for a conoe, kayak, or the like and which comprises, generally, an elongated tubular handle 10 made of high-strength aluminum or the like which carries a grip 12 having a ridge to apprise the paddler of the proper paddle orientation for most efficient paddling. The paddle includes one or more blades 14, two of which are illustrated in the embodiment of FIG. 1. Each blade 14 includes a blade body 15 made of resin-impregnated fiber material. Suitable composite materials are well known in the art and a description of such materials is therefore omitted for brevity.

Typically, such composite resin-fiber materials are formed or laid up in a suitable mold or the like so as to provide the molded part with the desired configuration.

In the present instance the blade body 15 is relatively thin, except for a longitudinally extending portion or rib 16 of enlarged transverse cross-sectional area. The rib 16 protrudes outwardly on opposite sides of the thinner adjacent portions of the blade body 15, as best seen in FIG. 5, and provides structural rigidity, and particularly resistance to lateral deflection of the blade body.

Although the blade body 15 may be formed in various ways familiar to those skilled in the art, one suitable method of fabrication includes the initial step of preparing two molds (not shown) for molding an upper body part 18 and a lower body part 20, as seen in FIG. 5, which are later joined by any suitable adhesive to form the blade body 15.

The rib 16 includes inner walls which define an elongated, longitudinally oriented recess 22 which is generally wider than it is thick. The recess 22 is closed at its outer end and terminates at the opposite or inner end in a cylindrical end portion or cavity 24 which is adapted to closely receive the outer surfaces of the end of the tubular handle 10. For convenience, the portion of the recess 22 located outwardly of the recess end portion is termed the "recess main portion."

The handle 10 is usually a standard extrusion and the end of the handle 10 is preferably swaged to a reduced, close tolerance external diameter to provide a precision or close fit with the inner walls of the cavity 24. The degree of swaging is slight, being exaggerated in the drawings for clarity.

To provide additional resistance to lateral deflection of the blade body 15, a tubular element 26 made of light weight, high strength material such as aluminum is located within the recess 22. The element 26 has a transverse cross sectional area less than that of the recess 22, the difference in cross sectional areas producing spaces which are filled with a reinforcement material 28. The material 28 is preferably molded about the element 26 separately of the blade body 15 and thereafter incorporated in the blade body 15 at the time the blade body parts 18 and 20 are secured together. The molded material 28 completely fills the spaces between the element 26 and the inner walls of the main portion of the recess 22 to provide optimum resistance to lateral deflection of the blade body 15.

As best seen in FIG. 3, the portion of the reinforcement material 28 which is located in the end cavity 24, that is, inwardly of the main portion of the recess 22, is molded so that its outer walls are uniformly spaced from the inner walls of the cavity 24, thereby defining an annular socket which is adapted to closely receive the end of the tubular handle 10. The fit is preferably a close, precision fit.

As shown in dotted outline in FIG. 2, the reinforcement material 28 terminates short of the outer end of the recess 22, but extends through the critical bend area, generally designated as 30, where the blade body 15 curves away from the longitudinal axis of the handle 10. It is in this bend area that high operational loads are encountered.

In separately molding the material 28 to the desired configuration, the tubular element 26 is first placed in the mold (not shown) and a suitable composite material, such as a catalyzed epoxy resin mixed with a filler of glass microballoons, is poured into the mold and allowed to set or cure. The resulting hardened mass can then be removed from the mold and inserted between the body parts 18 and 20 and fixed in position when the body parts 18 and 20 are adhesively secured or bonded together.

Resin-filler materials or the like suitable for use in the present invention are well known to those skilled in the art and a particular description of resins, catalysts, fillers, and curing times and temperatures are therefore omitted for brevity.

The strength of most resin-filler materials is such that there tends to be an undesirable crushing or compaction of the material under repeated heavy loads over prolonged periods of use. Such compaction results in a degree of relative movement between component parts, such as between the element 26 and the adjacent inner walls of the blade body 15. This is undesirable since such movement typically eventually results in breakage or structural failure of the paddle, particularly at the bend area 30. Accordingly, the element 26 is provided with a bend area 32 so that the element 26 fits within the cavity 24 and also within the remainder of the recess, whose longitudinal axis is at an obtuse angle relative to the longitudinal axis of the cavity 24. The element 26 is oriented in the mold for the material 28 such that the bend area 32 is flush with the top of the mold. Consequently, upon assembly of the molded material 28 within the blade body 15, the bend area 32 bears directly against the bend area 30 of the inner wall of the recess 22. Preferably the outer end 34 is also oriented in the mold so that it too is flush with the top of the mold so that upon assembly to the blade body 15 the outer end 34 bears directly against the inner wall of the recess 22 adjacent the outer end 34.

As best seen in FIG. 3, the element 26 is also preferably configured and oriented in the mold for the material 28 so that the area of the element 26 adjacent the bend area 32 will be located adjacent the inner end of the cavity 24 in position to bear against the inner end of the handle 10.

With the foregoing arrangement, flexing or lateral deflection of the blade body 15 is transmitted directly to the element 26, which transmits these loads to the handle 10. There is no reinforcement material 28 at high stress points which might become compacted and develop spaces productive of undesirable impact loads.

At the time the reinforcement material 28 is molded about the element 26, a pair of cylindrical blocks 36 are preferably disposed within the ends of the element 26 to prevent material 28 from flowing into the element 26, thereby tending to make the composite structure lighter in weight.

A ring 38 is adhered to the inner extremity of the blade body 15 to help hold the body parts 18 and 20 together in this area, which is a relatively highly stressed area. In addition, the ring 38 serves to apprise the user when the handle 10 and blade 14 are properly assembled. More particularly, to assemble these parts the inner and outer surfaces of the end of the handle 10 are coated with a suitable adhesive, such as a silicone type of adhesive, and the handle 10 is then inserted into the annular socket defined by the molded material 28 and the cavity 24. The ring 38 is so located and dimensioned that it is engaged by the end of the handle 10 when the handle 10 has been inserted to the proper depth within the cavity 24.

By reason of the unique construction of the present paddle blade, it is characterized by a high strength to weight ratio. In addition, the construction permits easy assembly of the blades to the handle so that they can be stored and shipped independently for later assembly at the point of use or sale. Moreover, should a blade become damaged, it can easily be removed and replaced with another blade by simply slipping the replacement blade over the original handle end.

Various modifications and changes may be made with regard to the foregoing detailed description without departing from the spirit of the invention.

I claim:

1. A paddle blade adapted to be mounted to a tubular handle, said blade comprising:

a blade body including a hollow, longitudinally extending reinforcing rib whose inner walls define an elongated recess having a cylindrical inner end portion adapted to closely receive the end of the tubular handle, and an outwardly extending main portion in communication with said end portion;

a tubular element located within said recess end portion and extending into said recess main portion, and having a transverse cross sectional area less than that of either said recess end portion or said recess main portion thereby to define spaces adjacent said element; and reinforcement means disposed about said element and engaging the inner walls of said recess main portion, said reinforcement means extending into said recess end portion in uniformly spaced relation to the inner walls of said recess end portion to thereby define an annular socket for receiving the end of the tubular handle.

2. A paddle blade according to claim 1 and including cylindrical blocks located in the ends of said tubular element; and wherein said reinforcement means overlies said ends of said element.

3. A paddle blade according to claim 1 wherein said reinforcement means is a resin-filler material.

4. A paddle blade according to claim 1 wherein said blade body is curved and the longitudinal axis of said recess end portion is angularly offset relative to the axis of said recess main portion; and wherein said element includes a bend whose inner portion is located adjacent the outer terminus of said socket without any significant amount of said reinforcing means therebetween whereby forces tending to straighten said element are transmitted substantially directly to the tubular handle in said socket.

5. A paddle blade according to claim 4 wherein the outer end of said element terminates adjacent the inner wall of said recess without any significant amount of said reinforcing means therebetween.

* * * * *